US006603388B1

(12) United States Patent
Perraud et al.

(10) Patent No.: US 6,603,388 B1
(45) Date of Patent: Aug. 5, 2003

(54) SECURITY SYSTEM AND METHOD

(75) Inventors: Eric Perraud, Tournefeuille (FR); Michel Burri, Grand Saconnex (CH)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/489,257

(22) Filed: Jan. 21, 2000

(30) Foreign Application Priority Data

Aug. 17, 1999 (EP) ..... 99402070

(51) Int. Cl.[7] ..... G05B 19/00; G06F 7/04; G06K 19/00

(52) U.S. Cl. ..... 340/5.61; 340/2.7; 340/2.8; 340/825.73; 340/5.63; 340/5.62; 370/342

(58) Field of Search ..... 340/5.61, 2.7, 340/2.8, 5.6, 825.73, 5.64, 5.63, 5.62, 825.72; 370/335, 342, 441; 375/130, 140, 145

(56) References Cited

U.S. PATENT DOCUMENTS 5,293,160 A * 3/1994 Kurozu et al. ..... 340/825.32
5,604,806 A * 2/1997 Hassan et al. ..... 380/44
5,844,517 A * 12/1998 Lambropoulos ..... 341/176
5,892,441 A * 4/1999 Woolley et al. ..... 340/539
6,323,566 B1 * 11/2001 Meier ..... 307/10.2

FOREIGN PATENT DOCUMENTS

| | | |
|---|---|---|
| DE | 4329697 | 3/1995 |
| DE | 9645808 | 5/1998 |
| WO | 9638996 | 12/1996 |
| WO | 9959284 | 11/1999 |

* cited by examiner

*Primary Examiner*—Brian Zimmerman
*Assistant Examiner*—Vernal Brown

(57) ABSTRACT

A security system for actuating a security mechanism of a vehicle includes a transceiver coupled to the security mechanism and having one transmission channel for transmitting a first signal and a number of reception channels. A remote radio-frequency transponder key has a number of transmission channels and one reception channel matched to the respective reception and transmission channels of the transceiver. The transponder key is arranged to transmit an unlock signal to the transceiver upon reception of the first signal. The unlock signal is verified by the transceiver as valid before actuating the security mechanism. The transceiver is further arranged to select a channel for reception of the unlock signal and to embed the identity of the selected channel in the first signal, such that the transponder key transmits the unlock signal using the selected channel.

10 Claims, 2 Drawing Sheets

SECURITY SYSTEM AND METHOD

FIELD OF THE INVENTION

This invention relates to security systems, and particularly but not exclusively to vehicle entry security systems which utilise remote key-less entry schemes.

BACKGROUND OF THE INVENTION

Remote Keyless Entry (RKE) is used widely in vehicles and other applications to allow a user to unlock a door or other opening without the need for a physical key to contact the door. Instead a button on the key fob is pressed by the user and a Radio-Frequency (RF) encrypted signal is sent to the vehicle. Upon decryption and verification of the signal the vehicle automatically unlocks the doors.

A further development of this system is the so-called 'passive' RKE, where the need for pressing a button is removed. Instead the user has a transponder (which may be incorporated in the key fob), and upon approaching the vehicle the user pulls the door handle as if the door were already unlocked. The vehicle sends out a Low Frequency (LF) signal with a range of 1 or 2 meters, and if the transponder is within this range it responds with a Ultra-High Frequency (UHF) encrypted signal which the vehicle receives. Upon decryption and verification of the received UHF signal the vehicle automatically unlocks the doors. The target time for this process is in the order of milliseconds, such that as the user continues to pull the door handle, the door opens.

A problem with both of the above systems is that there is a danger of unwanted interference from other UHF sources. In particular, if a number of vehicles in the vicinity of the user's vehicle also have RKE and/or 'passive' RKE, there is a danger of unwanted interference from these other vehicles. This is of particular significance with respect to 'passive' RKE as the interference may cause the target time to be significantly lengthened as further attempts to transmit and receive the UHF signal take place, thus preventing the user from successfully opening the door with a single pull of the door handle. At best this is an inconvenience, but in bad weather or a potentially dangerous situation this could have more serious consequences.

This invention seeks to provide a security system and method which mitigate the above mentioned disadvantages.

SUMMARY OF THE INVENTION

According to a first aspect of the present invention there is provided a security system for a vehicle as claimed in claim 1.

According to a second aspect of the present invention there is provided a method of operating a security system for a vehicle as claimed in claim 2.

In this way a security system is provided in which the danger of unwanted interference from other UHF sources such as RKE systems of other vehicles is reduced. In particular the target time of passive RKE entry is kept to a minimum, with an improved probability that the user can successfully open the door with a single pull of the door handle.

BRIEF DESCRIPTION OF THE DRAWINGS

An exemplary embodiment of the invention will now be described with reference to the drawing in which.

DETAILED DESCRIPTION OF A PREFERRED EMBODIMENT

Figure 1:
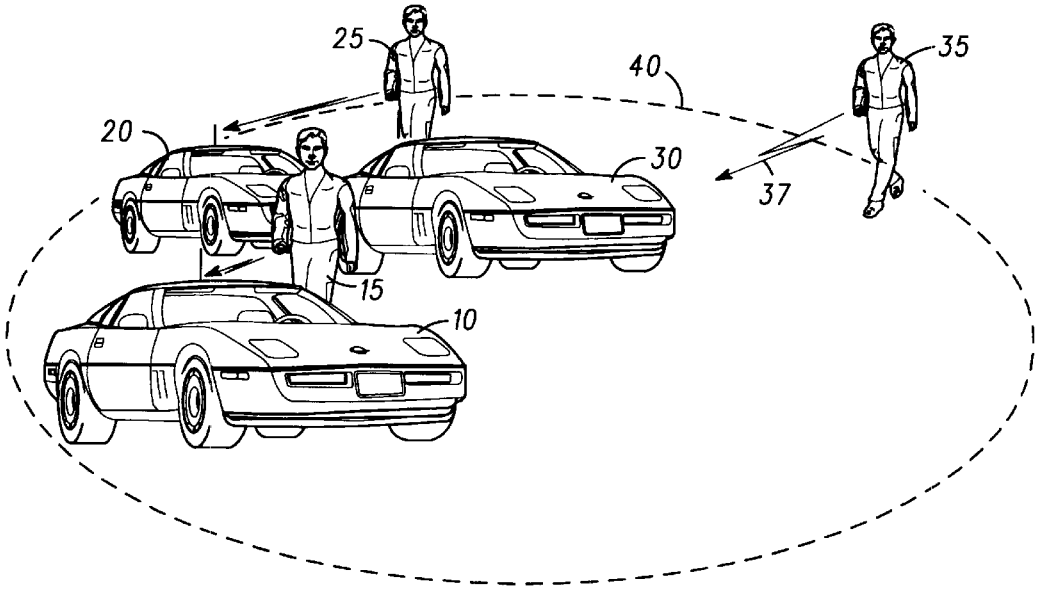
FIG. 1 shows an illustrative diagram showing a number of vehicles and a number of vehicle users.

Referring to FIG. 1, there is shown a number of vehicles 10, 20 and 30, which are parked in close proximity to each other. Each vehicle has a Remote Keyless Entry (RKE) system (not shown) which allows an owner or driver to unlock the vehicle by means of a activating a handheld transmitter arranged to transmit a signal to the vehicle. The signal has an associated security feature, such as an embedded code, which upon receipt of the signal by the vehicle, is compared to a stored value. If the stored value matches the value associated with the signal, the vehicles doors are automatically unlocked, facilitating entry to the vehicle by the driver.

At least one vehicle, for example, a first vehicle 10, is arranged to also support so-called passive RKE, in which the vehicle doors are automatically unlocked without the driver directly activating the handheld transmitter.

Figure 2:
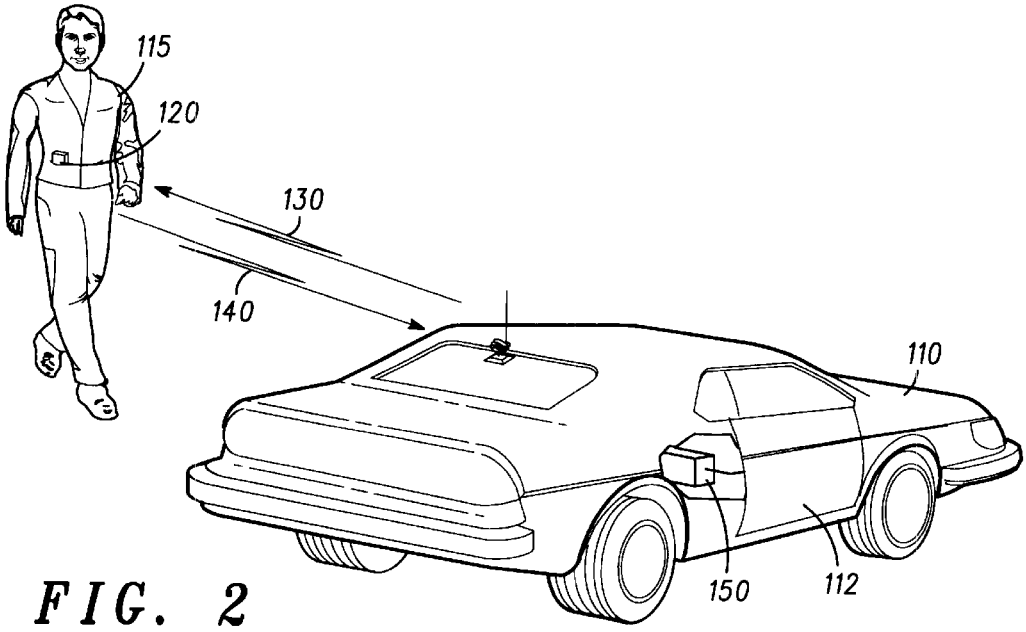
FIG. 2 shows an illustrative diagram showing transmission signals associated with a preferred embodiment of the invention; and, FIGS. 3 and 4 show timing diagrams of transmission sequences in accordance with a preferred and an alternate embodiment of the invention respectively.

Referring now also to FIG. 2, the passive RKE capability of a first vehicle 110 is shown. A driver 115 has a unit 120 which incorporates a transponder. This unit 120 may also incorporate a separate transmitter for 'active' RKE as described above. Similarly the transponder may be additionally arranged for active RKE. It will be appreciated that the unit 120 may also include an ignition key for the vehicle, and may be attached to a key-ring having other keys. When not in use, the unit 120 would typically be stored in a pocket, bag or other receptacle about the driver 115.

The vehicle 110 has a door 112, and a security controller 150 coupled to the door and incorporating a Low Frequency (LF) transmitter, an Ultra-High Frequency (UHF) receiver, and processing elements. The controller 150 may also control active RKE functions.

Passive RKE is beneficial when the driver 115 cannot readily manipulate the unit 120, (or the RKE transmitter in the case when the unit 120 does not also incorporate the transmitter) either because the driver's hands are engaged in another activity such as holding shopping bags, or because the unit 120 is not readily accessible through layers of clothing, shopping, etc . . .

To initiate passive RKE, the driver pulls a handle (not shown) of a door 112 of the vehicle 110. The handle incorporates a transducer (not shown) which sends a signal to the security controller 150. Upon receipt of this signal, the security controller 150 transmits a LF signal 130 within a range of one to two metres. Given this short range, the risk of data collision with other passive RKE enabled vehicles is relatively small. If the unit 120 is within the range of the LF signal, it is arranged to respond by transmitting an unlock signal 140 which is a UHF frequency signal (typically the same signal and frequency as for active RKE).

Upon receipt of the UHF signal, the security controller 150 verifies that the unlock signal is valid and if it is so, causes the locking mechanism(s) of the door 112 (and typically those of other openings of the vehicle 110) to be unlocked, thereby allowing access to the vehicle.

Typically the security controller 150 and unit 120 are so-arranged that if the LF signal 130 and the UHF signal 140 are received first-time, the time taken from the initiation of passive RKE (by pulling the door handle) to the unlocking of the door 112 is in the order of milliseconds, in which case the driver can continue pulling the door handle to open the door. As already mentioned, the risk of data collision with other passive RKE enabled vehicles in respect of the LF signal is relatively small, in view of the short range involved.

However, referring back to FIG. 1, there is a significant danger of data collision and/or interference in the UHF frequency band, since active RKE and many other applications use UHF frequencies, and the range of these signals is typically much greater. For example, a second driver 25 using passive RKE may be attempting to enter a vehicle 20. While the LF signals have a very low probability of interfering with each other, the UHF signals have a much higher probability of interfering, as the range is much greater. Similarly a third driver 35, operating a transmitter from a distance of some metres to send an active RKE signal 37, creates UHF interference in the entire region labelled 40.

Furthermore, vehicles are typically supplied with more than one key, and so will be typically supplied with a number of RKE units. If the driver 15 is accompanied by a passenger who has a further RKE unit. Initiation of passive RKE will trigger a UHF signal response from the driver's unit and the passenger's unit, which will almost certainly interfere. Finally, UHF frequencies may be jammed or interfered with by other transmission means.

Therefore, this high risk of data collision and/or interference for the UHF signal reduces the benefit of passive RKE, since the driver may have to pull the door handle a number of times in order for the door 12 to open. As stated above, this could have serious consequences in bad weather, or where there may be danger of attack from opportunist thieves or assailants.

Figure 3:
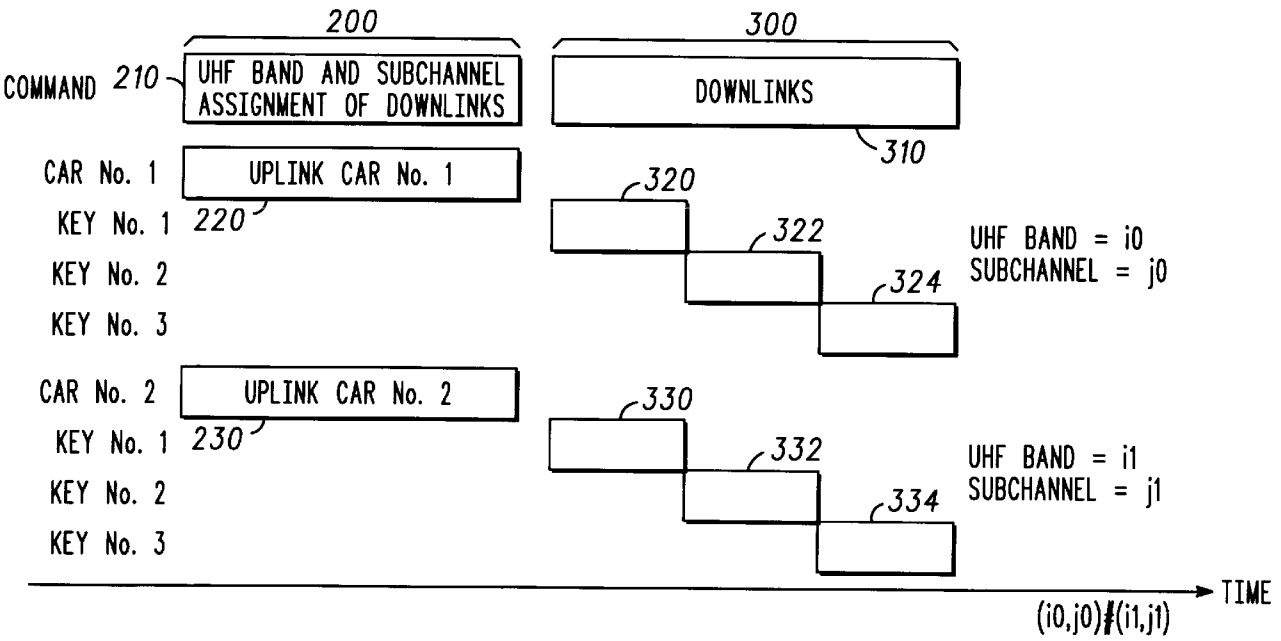

Referring now also to FIG. 3 there is shown a diagram of transmission signals associated with the security controller 150 and transponder 120. A first phase 200 represents LF 'uplink' transmissions, and a second phase 300 represents UHF 'downlink' transmissions.

The LF transmission 130 of FIG. 2 is represented by a first uplink transmission block 220 (from the controller 150 to the transponder 120). A second LF transmission by the second vehicle 20 is represented by a second uplink transmission block 230 (from the vehicle 20 to the unit of the second driver). Each of the uplink transmissions 220 and 230 contains an embedded sub-channel assignment value, to be further described below.

First, second and third downlink channels 320, 322 and 324 respectfully are time-division multiplexed, and provide non-overlapping time slots for transmission of UHF unlock signals by three different transponders (keys) for the first vehicle 10. In this way contention and interference between multiple transponders associated with the same vehicle is avoided. Furthermore the UHF frequency for all of these three downlink channels 320, 322 and 324 is a sub-channel of a UHF frequency band, and the sub-channel is selected from a number of sub-channels to be further described below.

Similarly first, second and third downlink channels 330, 332 and 334 respectfully are time-division multiplexed, and provide non-overlapping time slots for transmission of UHF unlock signals by three different transponders (keys)for the second vehicle 20. In this way contention and interference between multiple transponders associated with the same vehicle is avoided. Furthermore the UHF frequency for all of these three downlink channels 320, 330 and 340 is also a sub-channel of the UHF frequency band, the sub-channel being selected from a number of sub-channels to be further described below.

The sub-channel is selected by the security controller of each vehicle. In the case of vehicle 10 (110) the security controller 150 will select a sub-channel from those available to it. The selection itself may be random, or may be based on stored or real-time measured interference parameters of the sub-channels. Stored interference parameters may provide an optimal solution when a particular sub-channel is rarely interfered with (because no other vehicles or transmission devices utilise this sub-channel). Real-time interference parameters may be valuable in a heavily utilised car park (or parking lot) where all sub-channels are likely to be used, and the optimal channel is the one with least interference in real-time.

The sub-channels may be frequency-divided, in which case each UHF band defines a number of frequencies within the band. In this case, the criteria for channel selection will works as follows: the selected frequency sub-channel will be the sub-channel which is clear of data or which has the lowest received signal level. Alternatively, the sub-channels may be defined according to code-division multiple access (CDMA) in which a single frequency may be used, and a number of alternate codes are used to define sub-channels. In that case, the criteria for channel selection will works as follows: the received signal will be processed with the CDMA sub-channels in a mathematical operation function and the selected CDMA sub-channel will be the sub-channel which is clear of data or which does not have an autocorrelation signal.

Figure 4:
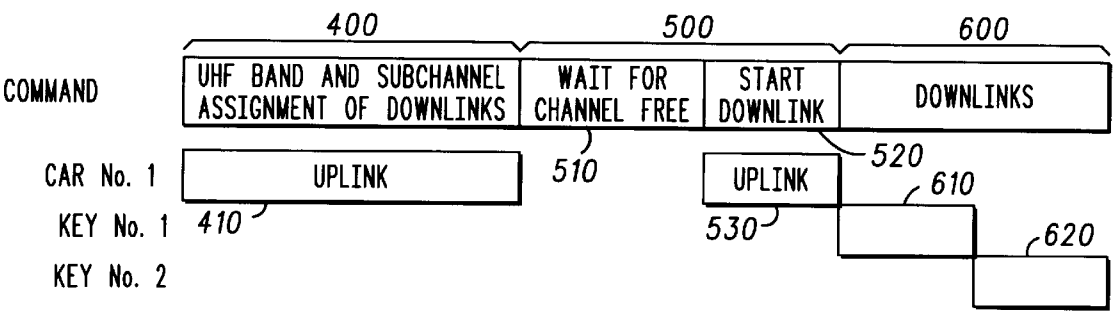

Referring now also to FIG. 4, there is shown an alternative transmission scheme, having an LF uplink phase 400 and UHF downlink phase 600. In this scheme, the security controller 150 randomly selects a sub-channel and sends the sub-channel information to the transponder 115 using a LF uplink transmission 410. Then the security controller 150 monitors the selected sub-channel (block 500) and waits if necessary (block 510) until the sub-channel is substantially clear of interference and other transmissions. When the sub-channel is clear, the downlink can take place (block 520), and the security controller 150 sends a further LF uplink transmission (block 530), indicating to the transponder 115 that the downlink can commence.

Once again the downlink phase 600 comprises a number of time-division multiplexed channels 610, 620 in order to provide non-overlapping time slots for transmission of UHF unlock signals by a number of different transponders (keys) for the first vehicle 10.

It will be appreciated that alternative embodiments to the one described above are possible. For example, the passive RKE could be initiated using a different method than the door handle pulling described above, such as voice or other noise activation, a pressure sensitive pad located about the vehicle, or even a proximity detector within the vehicle. Furthermore the precise arrangements of the channels and frequencies may differ from those described above.

What is claimed is:

1. A security system for a vehicle having a security mechanism, the system comprising:

a transceiver coupled to the security mechanism, the transceiver having one transmission channel for transmitting a command signal in a first frequency band and a plurality of reception channels for receiving unlock signals in a second frequency band, said second frequency band being substantially higher in frequency than said first frequency; and, a remote radio-frequency transponder key having a plurality of transmission channels in said second frequency band and a reception channel in said first frequency band matched to the respective reception and transmission channels of the transceiver, the transponder key being arranged to transmit an unlock signal to the transceiver in response to valid reception of the command signal, the unlock signal being verified by the transceiver as valid before actuating the security mechanism, wherein the transceiver is arranged to select a channel within said second frequency band for reception of the unlock signal and to embed the identity of the selected channel in the command-signal, such that the transponder key transmits the unlock signal using the selected channel.

2. The system of claim 1 wherein the transceiver is arranged to select the channel for transmission of the unlock signal by the transponder key in response to levels of interference or noise present in said plurality of channels immediately prior to transmission of the command signal.

3. The system of claim 2, wherein the transceiver is arranged to change the selected channel in favor of a channel which has a lower level of interference or noise.

4. The system of claim 2 wherein the reception selected channel is a CDMA sub-channel not having an autocorrelation peak after a mathematical correlation.

5. The system of claim 1 wherein the transmission of the command signal is triggered by actuation of a sensor coupled to the vehicle.

6. The system of claim 5 wherein the sensor is arranged to detect when a door opening mechanism of the vehicle is activated by the user.

7. The system of claim 6 further comprising a second transponder key having the same transmission and reception channels as the transponder key, the transponder key and the second transponder key being arranged to transmit their respective unlock signals sequentially such that interference therebetween is avoided.

8. The system of claim 7 wherein the sequential arrangement is provided by defining time-division multiplex channels within each of the plurality of reception channels.

9. The system of claim 2 wherein the transceiver is arranged to select a frequency sub-channel dependence upon the levels of spectra interference in a plurality of said frequency sub-channels.

10. The system of claim 1 wherein said first frequency band is in the Low Frequency radio frequency range and said second frequency band is in the Ultra High Frequency radio frequency range.

* * * * *

UNITED STATES PATENT AND TRADEMARK OFFICE

CERTIFICATE OF CORRECTION

PATENT NO. : 6,603,388 B1
DATED : August 5, 2003
INVENTOR(S) : Eric Perraud et al.

It is certified that error appears in the above-identified patent and that said Letters Patent is hereby corrected as shown below:

Column 6,
Line 12, change "spectra" to -- spectral --.

Signed and Sealed this

Twentieth Day of January, 2004

JON W. DUDAS
*Acting Director of the United States Patent and Trademark Office*